US005586921A

United States Patent [19]

Kobayashi et al.

[11] Patent Number: 5,586,921

[45] Date of Patent: Dec. 24, 1996

[54] WATERCRAFT

[75] Inventors: Noboru Kobayashi; Tomoyoshi Koyanagi; Keijiro Ikeda, all of Iwata, Japan

[73] Assignee: Yamaha Hatsudoki Kabushiki Kaisha, Iwata, Japan

[21] Appl. No.: 446,282

[22] Filed: May 22, 1995

Related U.S. Application Data

[62] Division of Ser. No. 997,599, Dec. 28, 1992, Pat. No. 5,449,305.

[30] Foreign Application Priority Data

Dec. 28, 1991 [JP] Japan ..... 3-359432

[51] Int. Cl.[6] ..... B63H 11/00

[52] U.S. Cl. ..... 440/38; 440/80; 114/274

[58] Field of Search ..... 114/270, 271, 114/274, 56, 57; 440/88, 89, 80, 38

[56] References Cited

U.S. PATENT DOCUMENTS

| | | | |
|---|---|---|---|
| 3,137,266 | 6/1964 | Perrier et al. . | |
| 3,330,239 | 7/1967 | Dornak | 114/56 |
| 4,276,035 | 6/1981 | Kobayashi . | |
| 4,568,293 | 2/1986 | Yazaki . | |
| 4,688,509 | 8/1987 | Nishida . | |
| 4,760,814 | 8/1988 | Kobayashi . | |
| 4,790,783 | 12/1988 | Karls | 114/56 |
| 4,801,282 | 1/1989 | Ogawa et al. . | |
| 4,836,812 | 6/1989 | Griffiths . | |
| 4,998,966 | 3/1991 | Yamaguchi . | |
| 5,094,640 | 3/1992 | Burdick et al. . | |
| 5,134,949 | 8/1992 | Almog et al. | 114/56 |
| 5,145,426 | 9/1992 | Kobayashi et al. . | |
| 5,237,950 | 8/1993 | Abe et al. . | |

FOREIGN PATENT DOCUMENTS

| | | | |
|---|---|---|---|
| 85090 | 3/1990 | Japan | 114/270 |

*Primary Examiner*—Stephen Avila
*Attorney, Agent, or Firm*—Knobbe, Martens, Olson & Bear

[57] ABSTRACT

A small watercraft powered by twin jet propulsion units, each driven by a respective engine. The engine is concealed within a hatch cover that has a larger portion which is removable for removal of the engine and a smaller portion which is pivotal for servicing of the engine without removing the larger portion. A centrally positioned operator's seat has a seat back with a handle so as to facilitate mounting of a rear deck and facilitate a passenger standing on the rear deck during operation. There are disclosed a pair of driving engines positioned within a V-hull in a central location so as to improve stability and yet permit extreme maneuverability. A fuel tank supplies fuel to the engines and is separated from the engines by a bulkhead with both the fuel tank and the engines being accessible when the smaller hatch cover is opened. A waterlock is also provided in the tunnel between the jet propulsion units for receiving and discharging the exhaust gases from the engine while precluding water from entering the engines through their exhaust systems in the event the watercraft becomes inverted.

21 Claims, 5 Drawing Sheets

WATERCRAFT

This application is a divisional application of application U.S. Ser. No. 07/997,599, filed Dec. 28, 1992 now U.S. Pat. No. 5,499,305, issued on Sep. 12, 1995.

BACKGROUND OF THE INVENTION

This invention relates to a watercraft and more particularly to an improved powering, seating and engine access arrangement for such a watercraft.

A wide variety of watercraft are available to the public. One type of watercraft which is extremely popular is a relatively small watercraft that is designed to be operated by a rider sitting in seated fashion and generally centrally positioned in the watercraft. Frequently, these types of watercraft are powered by jet propulsion units.

Conventionally, this type of watercraft includes only a single powering internal combustion engine and a single propulsion device, such as a jet propulsion unit, driven by that engine for propelling the watercraft. Although such arrangement have the advantages of simplicity, they do not offer as crisp control as dual propulsion units.

It is, therefore, a principal object to this invention to provide an improved small type of watercraft powered by twin engines and twin jet propulsion units.

It is a further object to this invention to provide an improved, small twin jet propelled watercraft designed to be operated by an operator in a centrally positioned seat.

When watercraft are propelled by a pair of engines, the hull tends to be quite wide and although this provides stability, it does not necessarily provide rapid maneuverability for the watercraft. However, if the placement of the engines is such that the hull is maintained in a narrow relationship, then stability can become a problem.

It is, therefore, a still further object to this invention to provide an improved small type of watercraft having a V-bottom hull and twin side by side engines that will offer quick maneuverability but also which will have good stability.

In watercraft, particularly small watercraft propelled by jet propulsion units of the type described, there is a likelihood that the watercraft may be capsized due to its very sporting nature and the manner in which these watercraft are operated. Frequently, the exhaust gases from the internal combustion engine which power the watercraft are discharged into the body of water in which the watercraft is operating. If the watercraft becomes capsized, there is a risk that the water may flow back into the power plant through its exhaust system and cause damage.

Various types of water traps have been proposed in the exhaust systems of watercraft to prevent this occurrence. However, when the watercraft is small and powered by a pair of internal combustion engines, the space limitations may preclude such water traps in the exhaust.

It is, therefore, a still further object to this invention to provide an improved water trap arrangement for a small watercraft having a pair of powering internal combustion engines.

With small watercraft of the type described, the engine or engines are normally positioned forwardly of the operator and beneath a hatch cover. However, frequently the hatch cover also supports the steering mechanism and/or other controls and this makes accessibility of the engine a problem. This is particularly acute in that certain components of the engine should be accessed and checked frequently, and this may be difficult with previously proposed type of hatch constructions.

It is, therefore, a still further object to this invention to provide an improved hatch structure for a small watercraft.

It is another object to this invention to provide a hatch cover for a small watercraft wherein a small hatch opening is provided for periodic servicing and wherein the hatch may be completely removable so as to access and remove the complete engine.

In connection with small watercraft of the type described, it has been the practice to position the fuel tank for the engine within the same compartment as the engine. This has rise to obvious disadvantages.

It is, therefore, a still further object to this invention to provide an improved engine and fuel tank arrangement for a small watercraft.

It is a further object to this invention to provide an engine, fuel tank arrangement for a small watercraft wherein the engine and fuel tank are separated by a bulkhead.

As has been noted, small watercraft of the type described are quite sporting in nature. As a result of this, it is frequently the case that the operator and/or passengers may operate the watercraft in swimming suits. This permits the operator and passengers to enter the body of water in which the watercraft is operating at will. However, where the watercraft is controlled by the operator in a single centrally position seat, there may be instances when a passenger may wish to ride the watercraft in a standing fashion. Also, it is desirable to provide some means to permit ease of access and entry to the watercraft.

It is, therefore, a still further object to this invention to provide an improved seating arrangement and deck arrangement for a small watercraft wherein the watercraft may be mounted from the rear and a grab handle is afforded on the seat for assistance in this regard.

SUMMARY OF THE INVENTION

A first feature of this invention is adapted to be embodied in a small watercraft that is comprised of a hull defining a passenger area in which a centrally positioned seat is provided. A pair of internal combustion engines are disposed in side by side relationship of the hull and each drive a respective jet propulsion unit, also in side by side relationship, for propelling the watercraft.

Another feature of the invention is adapted to be embodied in a small watercraft having a hull with a lower portion formed by a pair of angularly inclined surfaces extending outwardly from the center of the hull to define a V-bottom. The angularly inclined surfaces terminate at their outer ends in respective stripes which join each of the surfaces to another under hull surface. A pair of engines are supported within the hull in the area disposed between the strips and propulsion means driven by the engine to propel the watercraft.

A further feature of the invention is adapted to be embodied in a small watercraft having a hull with a pair of engines disposed in side by side relationship in the hull. Each of the engines has an exhaust pipe. A waterlock is disposed in the hull along the longitudinal center line of the watercraft for receiving the exhaust gases from the exhaust pipes and discharging the exhaust gases to the atmosphere. The waterlock is provided with an internal trap for precluding the entry of water into the exhaust pipes from the waterlock.

A further feature of the invention is adapted to be embodied in a small watercraft having a hull defining an engine compartment in which an internal combustion engine is positioned. A removable two piece hatch assembly encloses the engine compartment and is comprised of a first small hatch portion removable separately from the other hatch portion and sized adequately to afford servicing of the engine but not removal of the engine. The second hatch portion is sufficiently large so as to permit removal of the engine when both of the hatch portions are removed from the hull.

A still further feature of the invention is adapted to be embodied in a small watercraft having a hull defining an internal volume. An internal combustion engine is provided within the volume and drives a propulsion device for propelling the watercraft. A fuel tank is positioned within the volume for supplying fuel to the engine and bulkhead separates the fuel tank from the engine.

Another feature of the invention is adapted to be embodied in a small watercraft having a hull defining a rider's area at the rear of the hull. A seat is positioned at the rear of the rider's area and has a seat back. An open deck area is formed to the rear of the seat for accommodating a standing rider. The seat back is formed with a handle for grasping by a rider standing on the deck.

DETAILED DESCRIPTION OF THE PREFERRED EMBODIMENTS OF THE INVENTION

Figure 1:
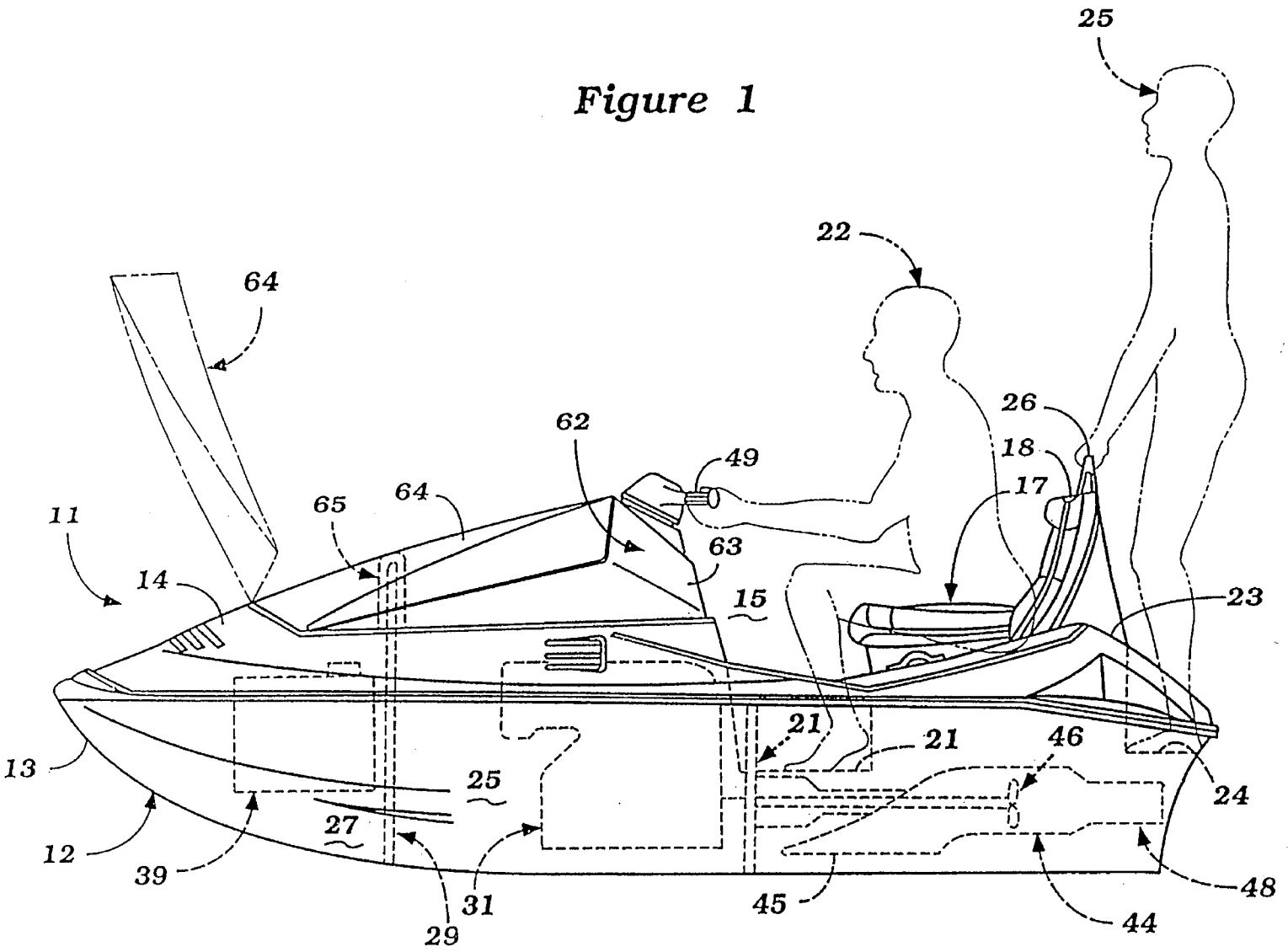
FIG. 1 is a side elevational view of a small watercraft constructed in accordance with an embodiment of the invention, with a rider and passenger shown in phantom and with a portion of the hatch cover closed shown in solid lines and open for engine access shown in phantom lines.
Figure 2:
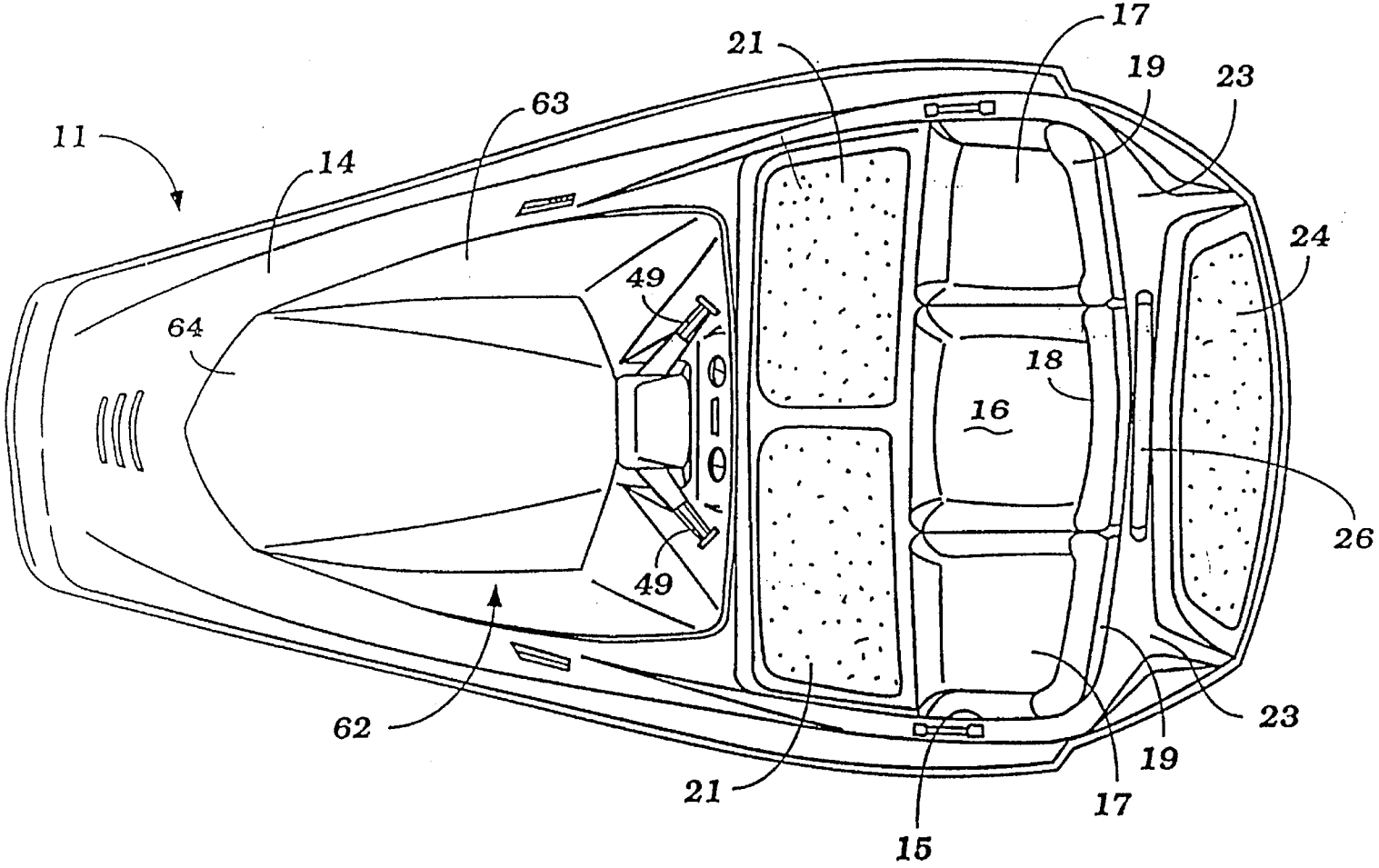
FIG. 2 is a top plan view of the watercraft.

Referring now in detail to the drawings and initially to FIGS. 1 and 2, a small watercraft constructed in accordance with an embodiment of the invention is identified generally by the reference numeral 11. The watercraft 11 is comprised of a hull, indicated generally by the reference numeral 12 and comprised of a lower hull portion 13 and an upper deck portion 14. The hull portions 13 and 14 are formed from a suitable material such as a molded fiberglass reinforced resin. The hull portion 13 and deck portion 14 are affixed to each other around their peripheral edges in any suitable manner.

A passenger compartment, indicated generally by the reference numeral 15 is provided to the rear of the hull 12 and accommodates a single transversely extending seat, which may be comprised of three portions consisting of a central rider's portion 16 and a pair of side, passenger portions 17. The seat portions 16 and 17 have respective seat backs 18 and 19. As may be seen, there are provided bolsters between the seats 16 and 17 so as to provide some lateral support. Thus, the seats 16 and 17 as illustrated comprise three side by side portions. It is to be understood, however, that the invention may be practiced with a single bench type seat. Foot areas 21 are provided forwardly of the seats 16 and 17 so that a rider, shown in phantom at 22 in FIG. 1, may sit upon the seat 16 with his feet in the foot area 21 in a normally seated fashion. In a like manner, passengers may sit in the seats 17 so as to also sit in a normally seated fashion.

A pair of raised rear gunnels 23 are formed on opposite sides of the rider's area 15 and to the rear of the seats 16 and 17. A deck area 24 extends between the rear of these gunnels 23 and provides a place where a passenger, indicated at 25 in FIG. 1, may stand. In addition, the rear deck area 24 permits access for entry to the watercraft 11 from the rear. So as to afford stabilization and assist in entry and also to permit the standing rider 25 to maintain his position, the seat back 18 of the rider's seat 16 is provided with a grab handle 26.

Figure 3:
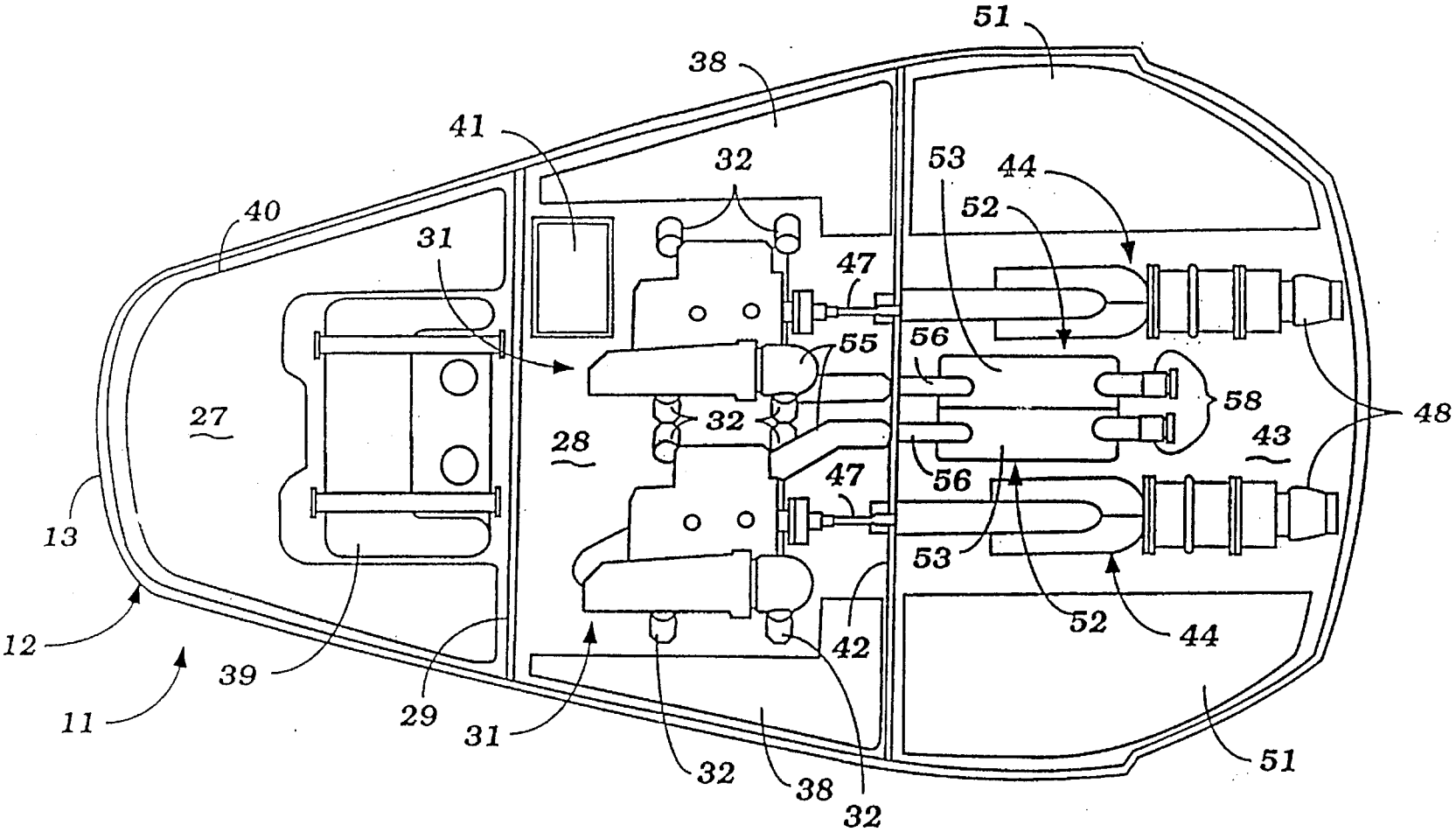
FIG. 3 is a top plan view of the watercraft, with the upper hull portion removed so as to show the location and orientation of the internal components.
Figure 4:
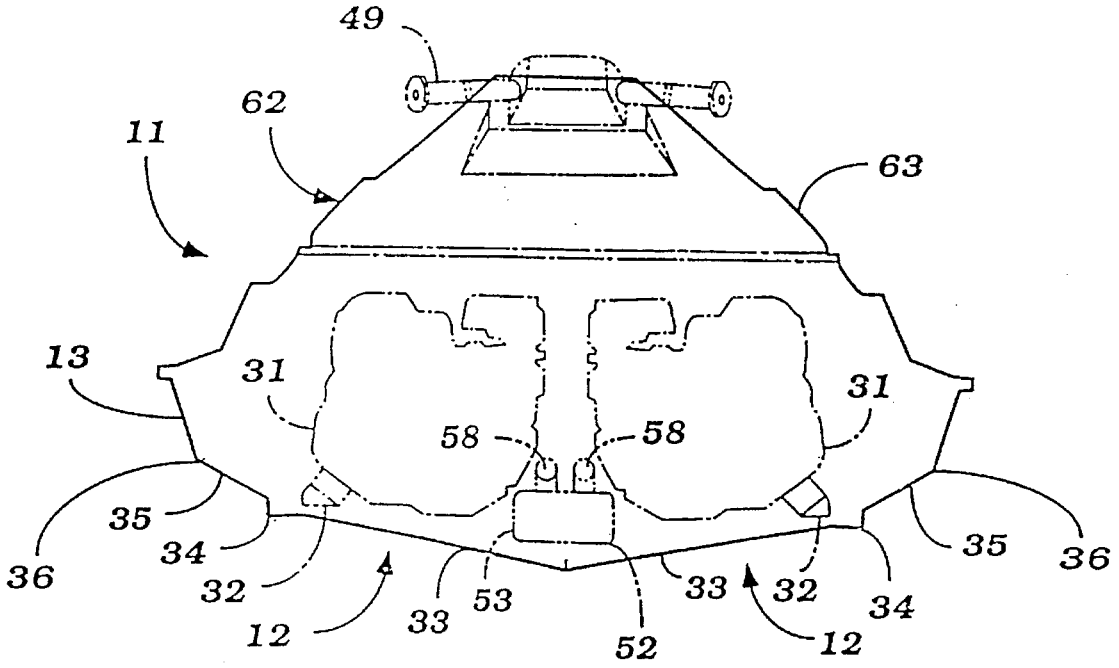
FIG. 4 is a rear elevational view of the watercraft.

Referring now additionally to FIGS. 3 and 4, the hull portion 13 is divided into a forward compartment 27 and a central engine compartment 28 by an internal vertically extending bulkhead 29. A pair of powering internal combustion engine 31 are disposed in side by side fashion within the engine compartment 28. The engines 31 may be of any known type and in the illustrated embodiment, are of the two cylinder, inline, crankcase compression, two cycle internal combustion engine type. It is to be understood, however, that various other powering internal combustion engines may be employed. The engines 31 are mounted within the hull portion 13 on a plurality of resilient engine mounts 32.

As may be best seen in FIG. 4, the underside of the hull 12 has a generally V-bottom comprised of a pair of angularly disposed portions 33 which extend outwardly from the center of the hull 12 and which terminate at longitudinally extending stripes 34 which are disposed transversely outwardly of the engines 31 as clearly seen in this figure. This arrangement permits a fairly narrow hull which accommodates very quick and sharp maneuvering.

Figure 6:
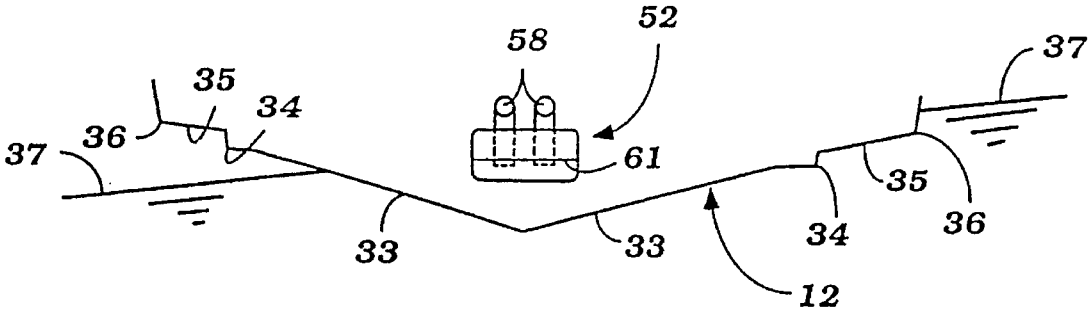
FIGS. 6 and 7 are partially schematic views showing the hull in the erect position (FIG. 6) and in the inverted position (FIG. 7) showing how the water trap operates.

Outwardly of the stripes 34, the hull 12 is provided with a pair of further inclined portions 35 which are inclined more steeply that the surfaces 33 and which terminate at further stripes 36. The portions 35 will become engaged in the body of water, as shown in FIG. 6 by the waterline 37, when maneuvering so as to afford stability as the watercraft 11 tends to lean or heel over. However, the portions 35 are normally out of the water when traveling straight ahead and hence will reduce drag and improve speed and maneuverability.

Referring again primarily to FIG. 3, a pair of floatation devices 38 such as foam, plastic blocks are positioned within the engine compartment 28 outwardly of the engines 31 so as to afford floatation.

A fuel tank, indicated generally by the reference numeral 39 is provided in the forward compartment 27 and is separated from the engine compartment 28 by the bulkhead 29. This provides obvious safety advantages and fuel is supplied from the fuel tank 39 to the engines 31 through appropriate conduits (not shown). A further buoyant block 40 is provided in the forward compartment 27 around the fuel tank 39 not only to protect the fuel tank 39 but also so as to afford further buoyancy.

A battery 41 may be positioned in the engine compartment 28 for offering a source of electrical power for accessories for the watercraft 11 and for starting. The battery 41 is charged by suitable magneto generators driven by the engines 31, in a well known manner.

A bulkhead 42 forms the rear portion of the engine compartment 28 and separates the engine compartment 28 from a tunnel area 43 in which a pair of jet propulsion units, indicated generally by the reference numeral 44 are supported in side by side fashion. Each jet propulsion unit 44 has a downwardly facing water inlet portion 45 through which water is drawn from the body of water in which the watercraft 11 is operated by means of an impeller 46 positioned in an impeller section and driven by the respective engine 31.

It should be noted that the engines 31 have their drive shafts 47 extending through the bulkhead 42 for driving the impellers 46 in a well known manner. The water thus pumped is then discharged through a discharge and steering nozzle 48 which is pivotally supported at the rear end of each jet propulsion unit 44 for powering the watercraft 11 and also for steering the watercraft 11. The steering nozzles 44 are connected to a steering handle bar assembly 49 which is mounted to the front of the rider's seat 16 and by which the steering nozzles 49 may be steered in a well known manner. The mounting for the handle bar assembly 49 will be described latter. It should also be understood that the handle bar assembly 49 may incorporate a throttle control for controlling the speed of the engines 31.

A further pair of buoyant masses, which may be formed from blocks of foam plastic and indicated generally by the reference numeral 51, are positioned transversely outwardly of the tunnel 43 and within the hull portion 42 as to afford further floatation for the hull 12.

Figure 5:
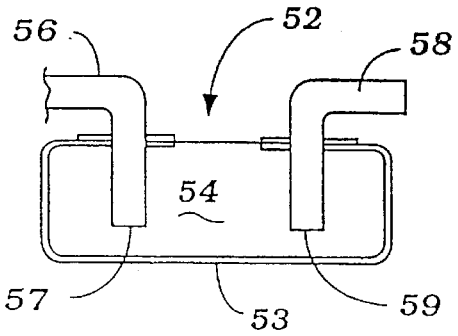
FIG. 5 is a longitudinal cross sectional view taken through the water trap device for the exhaust system of the powering internal combustion engines.
Figure 7:
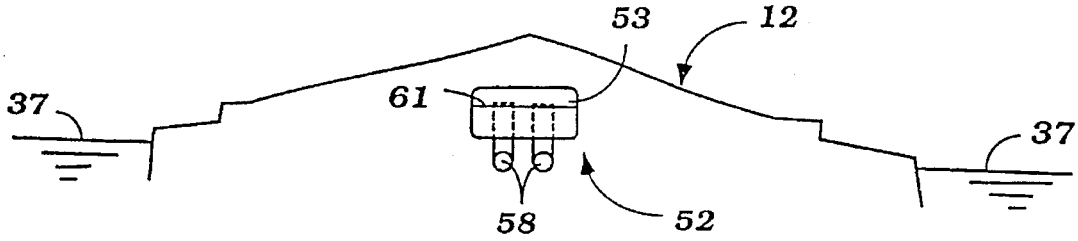

Positioned within the tunnel area 43 between the jet propulsion units 44 and generally along the longitudinal center line of the watercraft 11 are a pair of water trap devices 52 which, in the illustrated embodiment, are two units mounted together to form a common unit. These units 52 may be separate from each other but it is desirable to provide them on the longitudinal center line of the watercraft 11. Each water trap device 52 is comprised of an outer housing 53 that defines an internal chamber 54 (FIGS. 5 through 7).

As may be seen in FIG. 3, the engines 31 each have exhaust systems 55 which terminate in exhaust pipes 56 that extend through the bulkhead 42 and which have a right angle bend so as to enter the chambers 54. The lower end 57 of the exhaust pipes 56 are disposed at a spaced distance from the lower wall of the housing 53 so as to define an area wherein water may accumulate. As is typical with marine practice, the cooling water from the engines 31 may be discharged along with the exhaust gases from the exhaust pipes 56 into the water trap devices 52.

Exhaust discharge pipes 58 also have lower ends 59 positioned within the chambers 54 and discharge ends which extend into the tunnel area 43 and hence, the exhaust gases from the engines 31 and any cooling water discharge will pass through the water trap devices 52 and be discharged from the exhaust discharge pipes 58 into the atmosphere. The flow of the exhaust gases will insure that the coolant is also discharged back into the body of water in which the watercraft 11 is operating. However, when the engines 31 are stopped water will accumulate to a level as shown by the line 61 in the housings 53 and will partially submerge the lower ends of the exhaust pipes 56 and exhaust discharge pipes 58. However, if the watercraft 11 becomes inverted (FIG. 7) the pipe ends 57 and 59 will be positioned above the water level shown at 61 in this figure and water thus is trapped and prevented from flowing back into the engines 31 through their exhaust systems.

Referring now primarily to FIGS. 1, 2 and 4, the engine compartment 28 is accessible through a removable hatch assembly, indicated generally by the reference numeral 62. The hatch assembly 62 includes a main, larger hatch portion 63 which mounts the handle bar assembly 49. This hatch portion 63 when removed will offer free access to the engines 31 so that they can be removed completely from the hull 12. However, in order to permit ease of access to the engines 31 for servicing, such as changing spark plugs, etc., a smaller hatch portion 64 is pivotally connected to the hatch portion 63 so as to be moveable between a closed position as shown in solid lines in the figures and in open access position as shown in the phantom lines in FIG. 1. In this position, there is access to the engines 31 but the opening is not so large that the engines can be removed. Because of this, the main hatch cover 63 may be made more rigid since it need not be normally opened and closed for engine servicing while the openable portion 64 may be lighter in weight without reducing the strength of the overall assembly. Also the fuel tank 39 is accessible for filling when the portion 64 is opened.

The front bulkhead 29 is provided with a seal 65 which is engaged by the hatch portions 63 and 64 so as to permit sealing of the fuel tank 39 from the engines 31 when the hatch assembly is closed.

It should be readily apparent from the foregoing description that the described embodiment of the invention is very effective in fulfilling the objects aforestated. Of course, the foregoing description is that of a preferred embodiment of the invention and various changes and modifications may be made without departing from the spirit and scope of the invention, as defined by the appended claims.

We claim:

1. A small watercraft comprising a hull having a pair of chines which connect side surfaces of the hull with a hull bottom surface, said hull bottom surface including at least first and second stripes with said first stripe being disposed between one of said chines and a center of said hull and the second stripe being disposed between the other chine and the center of said hull, and a pair of propulsion devices supported within the hull in an area disposed between said first and second stripes,said propulsion devices include intake ports disposed between said first and second stripes, and the distance between said first stripe and the closest of said intake ports is greater than a distance between said first stripe and the closest chine.

2. A small watercraft as in claim 1, wherein said propulsion devices have discharge nozzles positioned generally at the stern of the watercraft between said first and second stripes.

3. A small watercraft as set forth in claim 1 wherein the hull defines a passenger area with a centrally positioned seat in a passenger area and a deck to the rear thereof.

4. A small watercraft as set forth in claim 3 wherein each of the engines is provided with an exhaust pipe and further including a waterlock disposed within the hull along the longitudinal center line of the watercraft and between the jet propulsion units for receiving the exhaust gases from said exhaust pipes and discharging the exhaust gases to the atmosphere, said waterlock being provided with an internal trap for precluding the entry of water into said exhaust pipes from said waterlock.

5. A small watercraft as in claim 1, wherein said stripes are symmetrically positioned about said intake ports.

6. A small watercraft as in claim 1 additionally comprising a pair of engines which drive said propulsion devices, said engines being supported within said hull in an area disposed between said stripes.

7. A small watercraft as in claim 1, wherein said first and second stripes are positioned closer to the corresponding chine than to the center of the hull.

8. A small watercraft as in claim 1, wherein said hull bottom surface includes a first pair of angularly inclined surface sections and a second pair of angularly inclined surface sections, said first pair of inclined surface sections extend from the center of the hull to define a generally V-shaped bottom portion, and each of said second pair of inclined surface sections extends toward the center of the hull from one of said chines.

9. A small watercraft as in claim 6, wherein said first and second stripes connect said second pair of inclined surface sections to said V-shaped bottom portion.

10. A small watercraft as in claim 6, wherein said first and second stripes connect to said second pair of inclined surface sections to vertically space at least in part said second pair of inclined surface sections above the outer edges of said V-shaped bottom portion.

11. A small watercraft as in claim 6, wherein said first pair of inclined surface sections form a first V-angle and said second pair of inclined surface sections form a second V-angle, said first V-angle being larger than said second V-angle.

12. A small watercraft as in claim 9, wherein said propulsion devices include intake ports which are disposed on said first pair of inclined surface sections.

13. A small watercraft as in claim 1, wherein said first and second stripes extend from a point proximate to the bow of said watercraft to the stern of said watercraft.

14. A small watercraft as in claim 1, wherein said hull defines a passenger area.

15. A small watercraft as in claim 12, wherein said passenger area includes a centrally positioned, transversely extending seat in said passenger area, said seat adapted to accommodate at least a rider and a passenger on either side thereof.

16. A small watercraft as set forth in claim 1, wherein the first pair of angularly inclined surfaces extend uninterruptedly from the center of the hull to the respective stripes connecting them to the pair of outer underside hull surfaces.

17. A small watercraft as set forth in claim 1, wherein the pair of propulsion devices are supported within the hull in the area between the first stripes and wherein the area between the center of the hull and the first stripes is generally uninterrupted by other stripes and/or chines.

18. A small watercraft as set forth in claim 1, wherein the propulsion devices comprise jet propulsion units having downwardly facing water inlet portions and rearwardly facing discharge portions, said water inlet portions being open through the lower surface of the hull in the area between the first and second stripes.

19. A small watercraft as set forth in claim 6 wherein each of the engines is provided with an exhaust pipe and further including a waterlock disposed within the hull along the longitudinal center line of the watercraft and between the jet propulsion units for receiving the exhaust gases from said exhaust pipes and discharging the exhaust gases to the atmosphere, said waterlock being provided with an internal trap for precluding the entry of water into said exhaust pipes from said waterlock.

20. A small watercraft as set forth in claim 19 wherein the waterlock is positioned between the pair of engines.

21. A small watercraft as set forth in claim 20 further including a fuel tank for supplying fuel to the engines, said fuel tank being separated from said engines by a bulkhead formed within the hull.

* * * * *